US008037825B2

(12) United States Patent
Niemeyer et al.

(10) Patent No.: US 8,037,825 B2
(45) Date of Patent: Oct. 18, 2011

(54) PRIMER ELEMENT

(75) Inventors: Torsten Niemeyer, Celle (DE); Joseph Adrianus Maria Van Dongen, Zeven (DE)

(73) Assignee: Rheinmetall Waffe Munition GmbH, Ratingen (DE)

( * ) Notice: Subject to any disclaimer, the term of this patent is extended or adjusted under 35 U.S.C. 154(b) by 74 days.

(21) Appl. No.: 12/523,002

(22) PCT Filed: Jan. 7, 2008

(86) PCT No.: PCT/EP2008/000043

§ 371 (c)(1),
(2), (4) Date: Jul. 13, 2009

(87) PCT Pub. No.: WO2008/083937

PCT Pub. Date: Jul. 17, 2008

(65) Prior Publication Data

US 2010/0000436 A1 Jan. 7, 2010

(30) Foreign Application Priority Data

Jan. 11, 2007 (DE) ..... 10 2007 002 457
Apr. 14, 2007 (DE) ..... 10 2007 017 679

(51) Int. Cl.
*F42B 3/12* (2006.01)
*F42C 19/12* (2006.01)

(52) U.S. Cl. ..... 102/202.7; 102/202.5; 102/202.14

(58) Field of Classification Search ..... 102/202.5, 102/202.7, 202.9, 202.14, 202.11
See application file for complete search history.

(56) References Cited

U.S. PATENT DOCUMENTS

| | | | | |
|---|---|---|---|---|
| 2,189,741 | A * | 2/1940 | Minton | 367/55 |
| 3,363,565 | A * | 1/1968 | Walther | 102/472 |
| 5,431,101 | A * | 7/1995 | Arrell et al. | 102/202.5 |
| 6,672,215 | B2 * | 1/2004 | Daoud | 102/202.14 |
| 6,761,116 | B2 * | 7/2004 | Daoud | 102/202.14 |
| 6,779,456 | B2 * | 8/2004 | Avetisian | 102/202.9 |
| 2004/0075260 | A1 * | 4/2004 | Heeke | 280/737 |
| 2004/0144458 | A1 * | 7/2004 | Kinoshita et al. | 149/108 |
| 2009/0126592 | A1 * | 5/2009 | Mukunoki et al. | 102/202.7 |

FOREIGN PATENT DOCUMENTS

| | | | |
|---|---|---|---|
| DE | 24 43 793 | | 3/1976 |
| DE | 33 46 146 | | 7/1985 |
| DE | 38 12 958 | | 11/1989 |
| DE | 39 02 617 | | 8/1990 |
| DE | 283 458 | | 10/1990 |
| DE | 42 22 223 | | 3/1994 |
| DE | 196 37 587 | | 3/1998 |
| DE | 199 28 832 | | 12/2000 |
| EP | 0 076 210 | A | 4/1983 |
| EP | 1 591 747 | A | 11/2005 |
| GB | 2 006 402 | A | 5/1979 |
| WO | 90/13529 | Y | 11/1990 |
| WO | 99/31456 | A | 6/1999 |
| WO | 2005/100905 | A | 10/2005 |

* cited by examiner

*Primary Examiner* — James Bergin
(74) *Attorney, Agent, or Firm* — Lucas & Mercanti, LLP; Klaus P. Stoffel

(57) ABSTRACT

The invention relates to a primer element, in particular for ammunition or similar, comprising at least one primer composition that has at least one sleeve acting as the housing for the primer element, at least one contact pin and a mass contact. Multiple wires, (at least two) are used, one end of said wires being connected to the contact pin and the other end of said wires to the mass contact. The multiple wires are embedded in the primer composition(s).

16 Claims, 1 Drawing Sheet

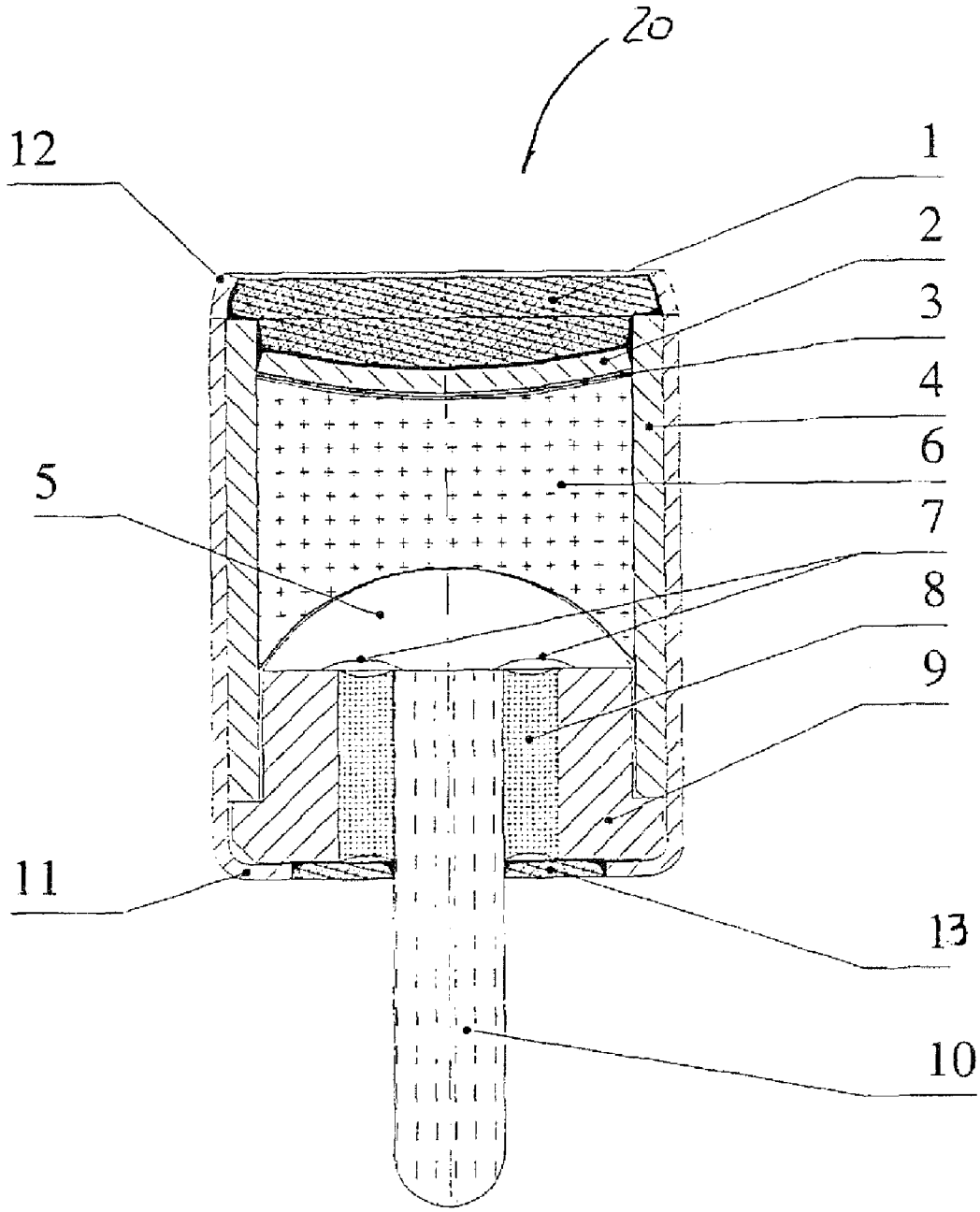
20
12
1
2
3
4
6
5
7
8
9
11
13
10

PRIMER ELEMENT

This application is a 371 of PCT/EP2008/000043 filed Jan. 7, 2008, which in turn claims the priority of DE 10 2007 002 457.8 filed Jan. 11, 2007 and DE 10 2007 017 679.3, filed Apr. 14, 2007, the priority of these applications is hereby claimed and both applications are incorporated by reference herein.

BACKGROUND OF THE INVENTION

The invention relates to a primer element, in particular for the propellant charge of a munition.

DE 199 28 832 A1 discloses an electrical primer device for the propellant charge of a cartridge, in which the arrangement is intended to be simplified and improved by use of the electromagnetic transmission principle.

An encapsulated electrical primer element is described in DE 38 12 958 A1. In order to prevent malfunctions, which can be initiated by radio-frequency interference energy, it is proposed that the conventional metal ring holding disk for a peened closure of the sleeve foot end be replaced by a dielectric in the form of a disk.

The primer system disclosed in DE 39 02 617 A1 deals with an improved primer behavior which can be achieved by a disk which is arranged between the initiation source and the primer charge and is composed of a porous, inorganic material.

An initiation or primer element with an initiation bridge arranged on a chip is disclosed in DE 196 37 587 A1. In order to allow it to be used universally and to avoid uncontrollable blowing out, it is proposed that the pins be passed into the housing of the primer element through a glass bushing.

DE 33 46 146 A1 deals with the problem of making reliable external contact with an initiation element, which is to be fired electrically, in the event of environmental stresses.

A combined primer cap is published in DE 24 43 793 C2. This has a first initiation charge, which can be initiated electrically, and a second primer system with an initiation charge which is sensitive to being pierced.

As a result of the change to the safety requirements, in particular with respect to electrostatic charges, the use of the previously used metal-foil elements as initiation bridges (for example as in DE 42 22 223 C1, DD 283 458 A5) in primer elements must be dispensed with.

SUMMARY OF THE INVENTION

The purpose of the invention is to provide an alternative to the initiation bridge, in order to prevent undesirable initiations of the primer element, in particular as a result of electrostatic charges.

The invention is based on the idea that it is desirable to (re-)use wires, in which case a good contact should be ensured between the wires and the primer mixture and, based on experience with previous use of individual wires in primer elements such as these, which has since been replaced by initiation bridges, since individual wires did not prove effective.

Multiple wires, for example two, are now used, with both wires being connected at one end to a contact pin of the primer element and at the other end to ground, and being bonded in a primer charge. The multiple wires make it possible to increase the cross section of the bridge wire and in this way to improve the dissipation of static energy (25 kV, 500 pF, 500Ω). The primer effect is improved by enlarging the contact areas between the wires and the primer mixture. The use of multiple wires also results in the advantage that the functional reliability is increased since, if the contact of one wire is interrupted, the connection is ensured via the other wire.

In one preferred embodiment, two primer charges are used, with the first primer charge being initiated by the multiple wires, and with the second primer charge being initiated by the first primer charge.

One development of the invention provides for glass bushings to be included in the body of the primer element as insulation between the contact pin and the ground contact. This furthermore results in better adhesion of the first primer mixture within the primer element, and thus in improved functional reliability. In principle, this considerably improves the safety against inadvertent initiation of the primer element.

BRIEF DESCRIPTION OF THE DRAWINGS

The single FIGURE is across section through a primer element pursuant to the present invention.

DETAILED DESCRIPTION OF THE INVENTION

The invention will be explained in more detail with reference to one exemplary embodiment and the drawing.

The single FIGURE shows the design of a primer element 20 having at least one primer charge 5, preferably having two primer charges 5, 6. The primer element 20 has at least one sleeve 11 which in this case additionally has an inner sleeve 4 added to it. The outer sleeve 11 is closed at its upper end, for example by means of peening 12.

A celluloid plate 2, which is coated with aluminum foil 3, is used as a seal for the explosives (primer charges 5, 6) and, as a closure, is pushed onto the upper, the second, primer charge 6. The curvature of the celluloid plate 2, which is directed inward, reinforces the attachment effect or seal effect. The peening 12 or other type of attachment of the outer sleeve 11 results in general attachment of the inner part of the primer element 20. The final sealing can be provided by application of a ring joint lacquer 1, in such a way that this is located under the peening 12 and can project into the inner sleeve 4. Alternatively, the covering disk 2, which is composed of celluloid or is coated with celluloid, can also be replaced by an aluminum disk, avoiding the need for the aluminum foil 3.

A first primer charge 5 is located underneath the second primer charge 6. The bonding of the first primer charge projects, preferably in a semicircular shape or the like, into the second primer charge 6. This makes it possible to positively increase the area for the transmission of the priming to the second priming 6. Two or more bridge wires 7 (=multiple wires) are preferably bonded in this primer charge 5 and make contact at one end with a contact pin 10 and at the other end with a ground. contact 9 of the primer element 20. The bridge wires 7 are preferably attached by welding. The diameter of the bridge wires is preferably in the order of magnitude of 250 μm.

A glass component, in this case in the form of a glass bushing 8, is preferably used as insulation between the contact pin 10 and ground 9. The ground contact 9 preferably makes metallic contact with the inner sleeve 4 and the outer sleeve 11.

A ring joint lacquer 13 is provided for sealing between the contact pin 10, which is passed through the outer sleeve 11, and the sleeve 11 itself.

In order to create the primer element 20, the primer mixture or the primer charge 5 is applied in the form of a thin liquid (such as water for example) to the ground contact 9 with the glass bushings 8. The heavy particles contained in the primer mixture 5 fall downward in the direction of the ground contact 9, while the liquid component rises upward and vaporizes. In this way, the primer mixture forms a solid outer skin, and a good adhesion effect is achieved between the glass of the glass bushing 8 and the metal of the ground contact 9. The second primer mixture or the second primer charge 6 can then be introduced into the sleeve 11 (sleeve 4).

The primer element 20 with the two primer charges 5, 6 operates as follows:

The two bridge wires 7 are heated suddenly, because of their very small diameter, after introduction of a current via the contact pin 10. The sudden temperature increase causes the first primer charge 5 to fire. After initiation of the first primer charge 5, the priming is transmitted to the second primer charge.

It is self-evident that the invention can be varied within the scope of the inventive idea. For example, when using only one electrical primer charge, the multiple wires 7 can also be bonded therein. The application or use of the multiple wires 7 in combined primer systems is also possible.

The invention claimed is:

1. A primer element, comprising: at least one sleeve as a housing; at least one primer charge arranged in the housing; at least one contact pin having a first end in contact with the primer charge and a second end extending out of the housing; a ground contact; and at least two multi-wires connected at one end to the contact pin and at the other end to the ground contact, the wires being embedded in the at least one primer charge.

2. The primer element as claimed in claim 1, wherein two primer charges are bonded so that a first of the primer charges is fired by sudden heating of the at least two multi-wires after introduction of a current via the contact pin, and priming is transmitted to a second of the primer charges after initiation of the priming.

3. The primer element as claimed in claim 1, and further comprising a glass bushing provided through the ground contact as insulation between the contact pin and the ground contact.

4. The primer element as claimed in claim 1, and further comprising a celluloid plate, which is coated with an aluminum foil, as an upper seal for the sleeve.

5. The primer element as claimed in claim 4, wherein the celluloid plate has a curvature directed inward.

6. The primer element as claimed in claim 4, wherein the upper seal is attached to the sleeve by peening.

7. The primer element as claimed in claim 4, and further comprising a ring joint lacquer as a final seal.

8. The primer element as claimed in claim 7, and further comprising a ring joint lacquer as a final seal.

9. The primer element as claimed in claim 1, and further comprising an aluminum disk as an upper seal for the sleeve.

10. The primer element as claimed in claim 9, wherein the upper seal is attached to the sleeve by peening.

11. The primer element as claimed in claim 1, and further comprising a ring lacquer provided for insulation of the contact pin which is passed through the sleeve.

12. The primer element as claimed in claim 1, wherein the primer charge is applied to the ground contact in thin-liquid form, whereby heavy particles fall downward, while liquid particles rise upward and vaporize.

13. The primer element as claimed in claim 1, where the at least two multi-wires are attached by welding.

14. The primer element as claimed in claim 1, wherein the multi-wires have a diameter of about 250 μm.

15. The primer element as claimed in claim 1, having two primer charges, wherein a first of the primer charges projects into a second of the primer charges.

16. The primer element as claimed in claim 15, wherein the first primer charge projects in a semicircular shape into the second primer charge.

* * * * *

UNITED STATES PATENT AND TRADEMARK OFFICE

CERTIFICATE OF CORRECTION

PATENT NO. : 8,037,825 B2
APPLICATION NO. : 12/523002
DATED : October 18, 2011
INVENTOR(S) : Torsten Niemeyer It is certified that error appears in the above-identified patent and that said Letters Patent is hereby corrected as shown below:

Title Page, below Item (75) should read

-- (73) Assignees: Rheinmetall Waffe Munition GmbH,
Ratingen (DE);
PL Elektronic GmbH,
Lilienthal (DE) --

Signed and Sealed this
Twenty-ninth Day of May, 2012

David J. Kappos

David J. Kappos
*Director of the United States Patent and Trademark Office*